US005251423A

United States Patent [19]

Turtschan

[11] Patent Number: 5,251,423

[45] Date of Patent: Oct. 12, 1993

[54] METHOD OF AND APPARATUS FOR STERILE PACKAGING USING STACKED PACKAGING ELEMENTS, ESPECIALLY PLASTIC CUPS WITH VARYING WALL THICKNESS

[75] Inventor: Alfons Turtschan, Schwabisch-Hall, Fed. Rep. of Germany

[73] Assignee: Gasti Verpackungsmachinen GmbH, Schwabisch-Hall, Fed. Rep. of Germany

[21] Appl. No.: 882,368

[22] Filed: May 6, 1992

Related U.S. Application Data

[63] Continuation of Ser. No. 702,601, May 17, 1991, abandoned.

[30] Foreign Application Priority Data

May 30, 1990 [DE] Fed. Rep. of Germany ..... 4017332

[51] Int. Cl.[5] ..... B65B 55/04

[52] U.S. Cl. ..... 53/426; 53/167; 53/202

[58] Field of Search ..... 53/89, 110, 167, 202, 53/426, 471, 281, 282; 422/28, 31, 34, 292, 302

[56] References Cited

U.S. PATENT DOCUMENTS

| | | | |
|---|---|---|---|
| 2,620,111 | 12/1952 | Hohl et al. | 53/471 X |
| 3,291,563 | 12/1966 | Martin . | |
| 3,477,192 | 11/1969 | Brown et al. | 53/471 X |
| 3,747,296 | 7/1973 | Zausner | 53/167 |
| 3,783,581 | 1/1974 | Pierce | 53/426 |
| 3,839,843 | 10/1974 | Stewart, Jr. . | |
| 4,014,158 | 3/1977 | Rausing | 53/167 |
| 4,296,068 | 10/1981 | Hoshino | 53/167 X |
| 4,563,855 | 1/1986 | Smith et al. | 53/426 X |
| 4,734,268 | 3/1988 | Redding et al. | 422/28 X |
| 4,987,721 | 1/1991 | Turtschan | 53/426 X |

FOREIGN PATENT DOCUMENTS

| | | |
|---|---|---|
| 2411142 | 10/1975 | Fed. Rep. of Germany . |
| 2724721 | 12/1977 | Fed. Rep. of Germany . |
| 2310661 | 5/1979 | Fed. Rep. of Germany . |
| 3640622 | 6/1988 | Fed. Rep. of Germany . |
| 2354102 | 1/1978 | France . |
| 589537 | 7/1977 | Switzerland . |
| 2226803 | 7/1990 | United Kingdom . |

*Primary Examiner*—John Sipos
*Assistant Examiner*—Linda B. Johnson
*Attorney, Agent, or Firm*—Herbert Dubno

[57] ABSTRACT

A filling and closing machine for the packaging of comestibles in plastic cups having different wall thicknesses has, in addition to the sterilizing chamber in which the cups are subjected to contact with $H_2O_2$ vapor followed by hot sterile air for the final sterilization, a presterilization chamber in which the cups are contacted with $H_2O_2$-containing air from the sterilizing chamber.

16 Claims, 3 Drawing Sheets

METHOD OF AND APPARATUS FOR STERILE PACKAGING USING STACKED PACKAGING ELEMENTS, ESPECIALLY PLASTIC CUPS WITH VARYING WALL THICKNESS

This is a continuation of co-pending application Ser. No. 07/702,601 field on May 17, 1991, now abandoned.

FIELD OF THE INVENTION

My present invention relates to a method of and an apparatus for the all-around sterilization of stacked packaging elements, especially plastic cups having different wall thickness over the height of the cup and in conjunction with the filling and sealing or closing of the packages. More particularly, the invention relates to a method and apparatus of packing sterile products, such as comestibles, in a filling and closing machine utilizing packaging cups and having a separate sterilizing chamber in which the packaging cups are subjected to treatment with a sterilizing agent such as hydrogen peroxide ($H_2O_2$) vapor and hot sterile air.

Specifically the invention relates to improvements in packaging systems in which a stack of cups can be separated at a sterilizing chamber through which the individual cups are advanced to a conveyor which moves these cups to the filling station of the machine in which the sterile cup is filled and then to a closing and/or sealing station in which the filled cup is closed and sealed under sterile conditions, the sterilizing chamber serving to treat the cup with $H_2O_2$vapor and then with sterile hot air to drive off the last traces of the hydrogen peroxide from the cup prior to the filling thereof.

BACKGROUND OF THE INVENTION

For the sterilizing of stacked containers, such as cups for the packaging of sterile materials like comestibles (see German patent 2,310,661), it is common to separate the containers of the stack for sterilization and to enable the sterilizing agent to contact all surfaces of the container. In this system, gripper devices on a circulating conveyor chain engage the containers and move them apart so that a gap can be provided between them. The gap must be sufficient to permit the sterilizing agent, for example, a 35% aqueous $H_2O_2$solution, to be sprayed from the spray nozzles along the inner and outer walls of the container to completely wet the latter with the hydrogen peroxide solution.

After spraying with the sterilizing agent, the containers are treated in a drying chamber downstream of the sterilizing chamber, to hot air. The hot air vaporizes residues of the sterilizing agent and the heat causes thermal decomposition of the hydrogen peroxide into water and oxygen, thereby eliminating the sterilizing agent from the containers.

In the packing of sterilized products in germ-free packaging under aseptic conditions, it is important that the sterilizing of the packaging materials, for example, plastic cups which can receive liquid (flowable) or pasty substances such as milk, yogurt, sour cream, prepared soups and the like, be effective to remove or destroy all pathogenic microorganisms and, further, that the film of $H_2O_2$which is applied to the inner and outer surfaces of the container be completely removed without thermal damage to the container.

The sterilization with hydrogen peroxide utilizes the strongly oxidizing effect of the concentrated hydrogen peroxide solution (35% concentration) at an elevated temperature (60° C. to 80° C.) which can result in a destruction of even resistant microorganisms, such as bacillus spores, with a contact time or residence time of the order of seconds. For the aseptic filling of neutral substances in packages having a volume of up to two liters, a reduction rate of resistant microorganisms, for example the *bacillus subtiliis* spores, of at least 4 orders of magnitude has been found to be necessary.

It is known that there is a relationship between the microorganism killing effect of hydrogen peroxide and its concentration and the temperature of the $H_2O_2$solution. The microbicidal effect of hydrogen peroxide increases with increasing concentration. The germ-killing effect of the hydrogen peroxide solution is also improved with increasing temperature.

A measure of the microbicidal effect is the so-called D-value (i.e. the decimal reduction time). This value is the time in minutes which results in a kill of 90% of the microbe population at a given constant temperature. A killing of refractory spore formers in the range of seconds, as is required in aseptic packaging machinery, is only possible with $H_2O_2$concentrations of about 30% and more at a minimum temperature of 80° C. to 90° C.

International regulations and those of the Food and Drug Administration have established strict guidelines with respect to the sterilizing effect which is required for foodstuff packaging and the like.

To satisfy these requirements, efforts have been made to increase the temperature of the $H_2O_2$solution which has been used. While this has been found to be effective in the treatment of foil-packaging materials, the sterilization of containers, especially plastic cups, has not been found to be as simple. Prefabricated plastic cups require various stacking elements, such as ribs, undercuts, raised bottoms or the like for their stability and separability. These regions require, for an effective microbial kill effect, a relatively-long contact time and a higher thermal efficiency for removal of the traces of the sterilizing agent than thin wall, uniform thickness packaging materials. The packaging cups with varying wall thicknesses are also more sensitive to thermal deformation in many instances.

While it has been recognized that the degree of microorganism contamination of a packaging material determines, by and large, the conditions under which sterilization must be effected to obtain the requisite sterility of the packaging material for the sterile packaging of foods and the like, it has also been found that the plastic cup packaging with variable wall thickness containers and intricate configurations of the cup are most susceptible to high degrees of contamination and thus have, in the past, generally required long contact times with the sterilizing agent, larger amounts of higher concentration sterilizing agents and longer periods of treatment with hot air for removal of the sterilizing agent.

OBJECTS OF THE INVENTION

It is the principal object of the present invention to provide an all-around sterilization of stacked packaging elements, especially plastic cups with different wall thicknesses, i.e. wall thicknesses which vary over the height of the cup, which can be carried out in a simple and economical manner and which satisfies even the strictest requirements for sterilization without detriment to the packaging material and without leaving residues of the sterilizing agent.

Another object of my invention is to provide an improved method of sterilizing stacked packaging materials, especially plastic cups, whereby the aforedescribed drawbacks of earlier systems are avoided.

Still another object of this invention is to provide an apparatus for carrying out the method of the invention in a minimum of space and with a minimum of capital expenditure.

Still another object of the invention is to provide a method of and an apparatus for the packaging of sterile substances in a packaging machine whereby the sterilizing operation is markedly improved by comparison with earlier systems.

SUMMARY OF THE INVENTION

In accordance with method aspects of the invention, these objects are attained, in accordance with the invention, by treating the packing elements, namely, the plastic cups, before their entry into the sterilizing chamber with $H_2O_2$-containing air in a presterilizing chamber upstream of the sterilizing chamber.

This can be accomplished by feeding the packing elements from the stack with a slight separation through the presterilizing chamber while retaining them in the presterilizing chamber with a resistance time so that in the conventional sterilizing chamber which follows and forms part of the packaging machine, the desired degree of sterilization is effected, in terms of the decimal reduction of the microorganisms. The $H_2O_2$-containing air for the presterilization can be, in principle, prepared independently of the sterilizing agent in the sterilizing chamber. However, it is preferred and it is a best-mode embodiment of the invention, that the presterilization of the packaging cups be effected by means of $H_2O_2$-containing air from the sterilizing chamber.

This provides the important advantage that the $H_2O_2$ waste air from the sterilizing chamber can be used directly for the presterilization. This $H_2O_2$-containing air should be controlled so that the $H_2O_2$concentration is 2000 to 2500 ppm. Investigations have shown that the temperature of the $H_2O_2$-containing air should be at least 90° C. and that the packaging elements should be presterilized for a residence time of at least 30 seconds before entering the sterilizing chamber.

Advantageously, $H_2O_2$-containing air is evacuated form the presterilizing chamber.

A method of sterile packing used stacked packaging elements can thus comprise the steps of:

(a) presterilizing the packaging elements with at least partial separation thereof from a stack of the elements prior to entry thereof into a separate sterilizing chamber of a filling and sealing machine with $H_2O_2$-containing air;

(b) introducing presterilized packaging elements from step (a) into the separate sterilizing chamber of the filling and sealing machine and contacting the elements in the chamber with $H_2O_2$vapor, thereby condensing $H_2O_2$on the elements, and thereafter contacting the elements with hot sterile air to remove $H_2O_2$from the elements and complete sterilization thereof; and (c) thereafter effecting sterile packaging with the elements in the machine.

The packaging elements can be plastic cups adapted to receive a food product as described.

According to an apparatus aspect of the invention, the apparatus for sterile packaging can comprise:

a presterilization chamber having an upper inlet opening and a lower outlet opening for presterilizing the packaging elements with at least partial separation thereof from a stack of the elements;

a filling and sealing machine having a separate sterilizing chamber formed with an upper inlet opening receiving the elements from the lower outlet opening of the presterilization chamber, the sterilizing chamber having a lower outlet opening;

means for presterilizing the elements in the presterilization chamber by contacting the elements in the presterilization chamber with $H_2O_2$-containing air; and means for contacting the elements in the sterilizing chamber with $H_2O_2$vapor, thereby condensing $H_2O_2$ on the elements, and thereafter contacting the elements in the sterilizing chamber with hot sterile air to remove $H_2O_2$ from the elements and complete sterilization thereof, sterile packaging with the elements in the machine being thereafter effected.

Thus the presterilizing chamber of the invention is formed as part of a filling and closing machine having a separate sterilizing chamber, e.g. of the type described in my commonly-owned U.S. Pat. No. 4,987,721. The sterilizing and presterilizing chamber can each have an upper inlet opening and a lower outlet opening for the stacked packaging elements and the sterilizing chamber can have an inlet for the sterilizing agent vapor mixture and means for contacting the cups with hot air therein. The presterilizing chamber upstream of the sterilizing chamber and from which the packaging elements are fed to the sterilizing chamber can receive the $H_2O_2$-containing hot air directly from the sterilizing chamber.

While the transfer of the packaging elements from the presterilizing chamber to the sterilizing chamber can be effected manually, I prefer to provide for automatic transfer of the packaging elements from the upstream chamber to the downstream chamber.

According to a feature of the invention, a suction duct is connected to the presterilizing chamber and this suction duct can open at a side of the presterilizing chamber opposite from that at which an inlet opens into the presterilizing chamber from the sterilizing chamber to deliver the $H_2O_2$-containing air thereto. This arrangement permits an especially uniform traversal of the presterilizing chamber to ensure that the containers therein will be contacted and flushed from all sides with the $H_2O_2$-containing hot air.

Both the sterilizing chamber and the presterilizing chamber, or either of them, can have a distribution chamber defined by a partition provided with throughgoing openings in the region of the inlet for the sterilizing fluid, thereby further facilitating uniform distribution of the sterilizing agents.

The perforations can be directed downwardly into the upwardly open cups in the chambers, thereby ensuring an especially effective introduction of the sterilizing agent into the interiors of the cups, whether the sterilizing agent is $H_2O_2$-containing air as is the case with the presterilizing chamber or an $H_2O_2$vapor as is the case with the sterilizing chamber.

It has also been found to be advantageous to provide baffle plates at the inlet sides of the distribution chambers of the sterilizing and presterilizing chambers and to provide the inlet sides of the presterilizing chamber and presterilizing chamber at diametrically opposite sides of the assembly of the chambers.

While a highly compact construction is obtained in a simple manner by mounting the presterilizing chamber above the sterilizing chamber, the presterilizing chamber can be provided at other locations and orientations as well. In the preferred construction, a common transport means can be provided to advance the cups through the presterilizing chamber and the sterilizing chamber.

Most advantageously, the transport means can be throughgoing conveyor worms extending through both chambers and having a uniform or constant pitch or a variable pitch and engaging the edges of the cups. The details of the construction of such worm feeders for cups and the manner in which the cups are separated from the stack and deposited upon the filling machine conveyor has been set forth in my aforementioned U.S. Pat. The portions of the machine relating to the filling of the cups and the closing thereof have also been fully set forth in this patent.

I can provide a plurality of sterilizing and presterilizing chambers in rows next to one another with a manifold system supplying a sterilizing agent to or conducting the sterilizing agent from the respective chambers.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
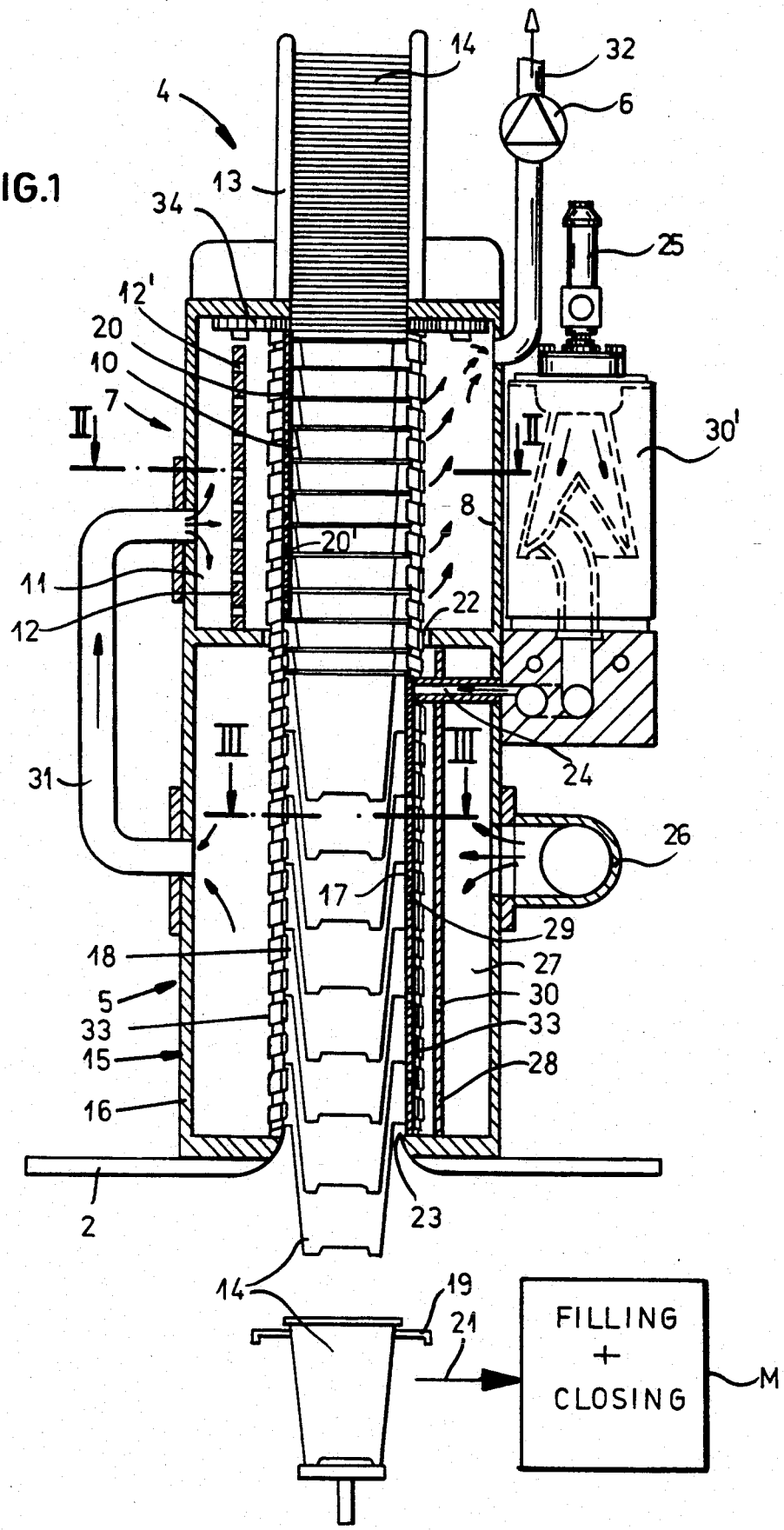
FIG. 1 is a vertical section through a sterilizing chamber and this presterilizing chamber for stacked cups forming part of a filling and closing machine of the type described in my above-mentioned patent and illustrating the principles of the present invention.

In FIG. 1 I have shown the presterilizing and sterilizing section of a filling and closing machine for the sterile packing of sterilizing product, e.g. a comestible, in a germ-free packaging material, the filling and closing portions of the machine being represented in FIG. 1 at M and having the construction illustrated in my aforementioned U.S. patent, for example. The filling product can be a liquid or pasty comestible such as milk, yogurt, sour cream, prepared soup, or the like. The packing material can be a prefabricated cup 14, for example, a plastic cup, which can have a bead **14*a* at its rim or mouth, a thin wall 14*b*, a rib 14*c* and a raised bottom 14*d* as has been illustrated in FIG. 1. Because of the scale, the cup 14** has been shown only in single line in FIG. 1.

The cup can, if desired, be composed of aluminum or a composite material.

Figure 1A:
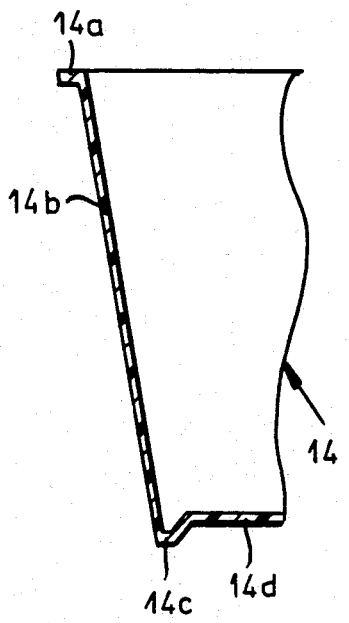
FIG. 1A is a section of the cup showing the different wall thicknesses over various portions thereof.

The packing cups can, as is apparent from FIG. 1A, have greater thicknesses at its bottom corners and rim by comparison to the thickness of the side wall **14*b*. The package can be closed by a cover or lid of plastic or aluminum, e.g. the embossed foil which can be heat-sealed to the rim 14*a***.

Within a housing 2 of the machine maintained at superatmospheric pressure with sterile air, a cup transporter 19 is provided to carry the sterile cups to the filling and subsequent stations in the direction of the arrow 21. The cup transporter may be a chain having pockets or openings receiving the successive cups.

The filling and closing machine also comprises a cup destacker and feed station 4 upstream of a sterilizing unit 5. The sterilizing unit 5 is comprised of a sterilizing chamber 18 and a presterilizing chamber 10 as will be described in greater detail hereinafter.

The cup destacking and feed station 4 comprises a stack magazine 13 in which a stack of the cups 14 can be introduced so that the cups are closely interfitted in the stack.

Below the stacking magazine 13, which can be formed by a number of spaced-apart bars or rods, the presterilizing chamber 10 is disposed. The presterilizing chamber 10 is located above the sterilizing chamber 18 and both chambers are sealed as required to maintain a reliable sterilizing atmosphere or appropriate sterilizing conditions in the two chambers.

Figure 3:
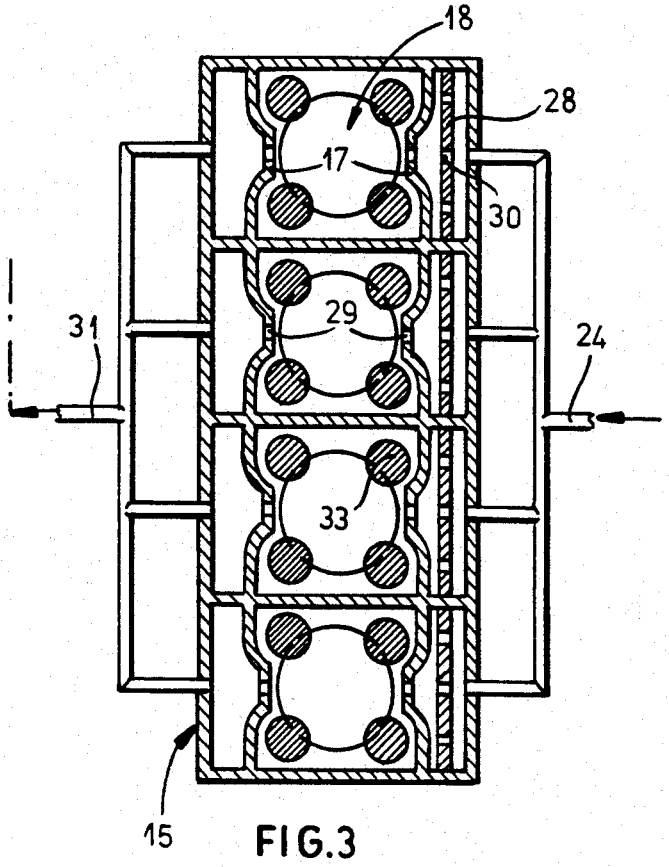
FIG. 3 is a view similar to FIG. 2 taken along the line III—III of FIG. 1.

The sterilizing chamber 18 can have a housing 15 which comprises an outer wall 16 and intermittent wall 17 (see also FIG. 3). The sterilizing chamber 18 is formed between these walls and is traversed by the separated cups 14. As the individual cups 14 leave the sterilizing chamber 18, they can be engaged by a gripper or suction element to be suspended in the plate 19 of the chain conveyor which can be formed with the pockets or holes (seals) in which the individual cups are accommodated as described previously.

The sterilizing chamber 18 has an inlet opening 22 through which the cups are fed and an outlet opening 23 from which the cups are delivered to the transporter for conveyance to the filling and closing stations.

The sterilizing chamber 18 also has an inlet 24 for a sterilizing agent, for example, a 35% $H_2O_2$-steam mixture which can be formed by a two-component nozzle 25, and a heating chamber 30'. The $H_2O_2$-steam mixture is distributed onto the inner and outer surfaces of the cups 14 and form a condensate film thereon.

The subsequent drying of the cups is effected with sterile air heated to about 200° C. and supplied via an inlet 26. The inlet 26 is connected with a distribution chamber 27 defined in part by a baffle plate 28 formed with throughgoing openings 30. This provides good distribution of the hot air.

From the distribution chamber 27, the hot air is directed downwardly and inwardly by similarly-directed orifices 29 in the intermediate wall 17 located on the inflow side of the sterilizing chamber 18. The hot air decomposes the $H_2O_2$in part to atmospheric oxygen and water. The residual hydrogen peroxide in vapor form is evacuated from the stabilizing chamber via a suction applied to the presterilizing chamber 10 and the duct 31 connecting these chambers. The peroxide-air mixture thus flows through the duct 31 into the sterilizing chamber 10 which is evacuated through the duct 32 opposite the duct 31 via a vacuum pump or suction blower.

Figure 2:
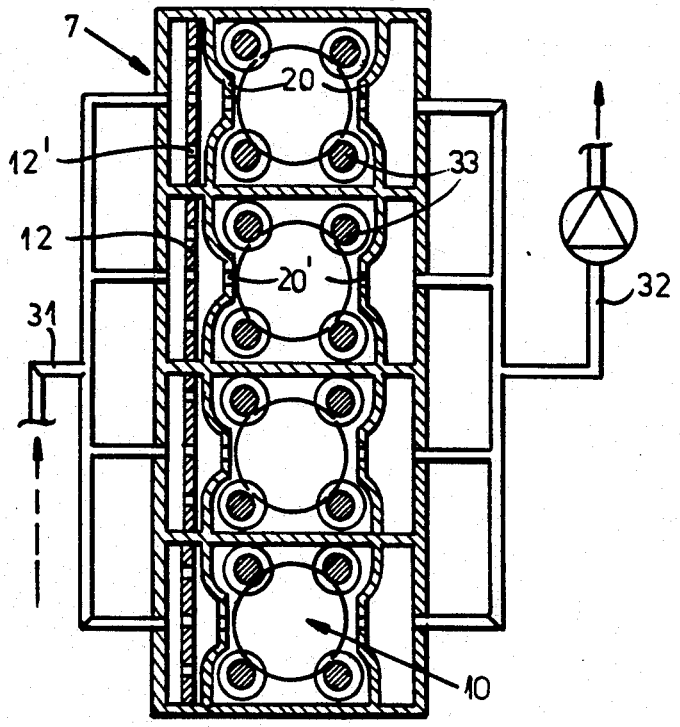
FIG. 2 is a diagrammatic elevational view through a partially sectioned row of presterilizing chambers as taken along the line II—II of FIG. 1.

While only one sterilizing chamber 18 and only a single presterilizing chamber 10 have been shown in FIG. 1, in actuality a plurality of such chambers can be provided in a row one behind the other as has been indicated in FIGS. 2 and 3. In this case, the individual chambers are each connected by a manifold to the inlet 24 by a manifold to the outlet side of the duct 31, by a manifold to the inlet side of the chambers 10 and by a further manifold to the suction duct 32. These manifolds are clearly visible in FIG. 2 and FIG. 3.

The presterilizing chamber 10 is also surrounded by a housing 7 that comprises an outer wall 8 and an intermediate wall 20. The intermediate wall 20 is disposed on the inlet side and has downwardly and inwardly directed orifices 20'. In FIG. 1, to simplify the illustration, only one intermediate wall 20 is disposed on the inlet side and has downwardly and inwardly-directed orifices 20'. In FIG. 1, to simplify the illustration, only one intermediate wall has been shown in the sterilizing chamber 18 and the presterilizing chamber 10 to enable the flow paths to be illustrated by the arrows. Other flow distribution wall arrangements can, however, also be used.

The housing 7 of the presterilizing chamber 10 is formed in addition with a distribution chamber 11 which can have a baffle plate 12 at the inlet side, formed with throughgoing openings 12' to further distribute the $H_2O_2$-containing air at a temperature of at least 90° C. and a concentration of 2000 to 2500 ppm flows from the distribution chamber 11 via the openings 20' in the partition 20 of the sterilizing chamber 10 into the latter. In the latter, the containers 14 are flushed on all sides with the $H_2O_2$-containing air and are presterilized in this manner. The presterilizing residence time in the chamber 10 for the cups 14 should be at least 30 seconds.

The cups are advanced through presterilizing chamber 10 and the sterilizing chamber 18 with separation by the conveyor worm 33 in accordance with the principles set forth in my earlier-mentioned patent. The conveyor worms 33 are formed in one piece and are synchronously driven by gears 34 forming a gear train and a drive (not shown). In the region presterilizing chamber 10 and the cup stack, the worms 33 can have a smaller pitch than in the region of the sterilizing chamber so that the cups are more closely spaced together in the presterilizing chamber than in the sterilizing chamber. The spacing ratio can be 1:2.

Figure 4:
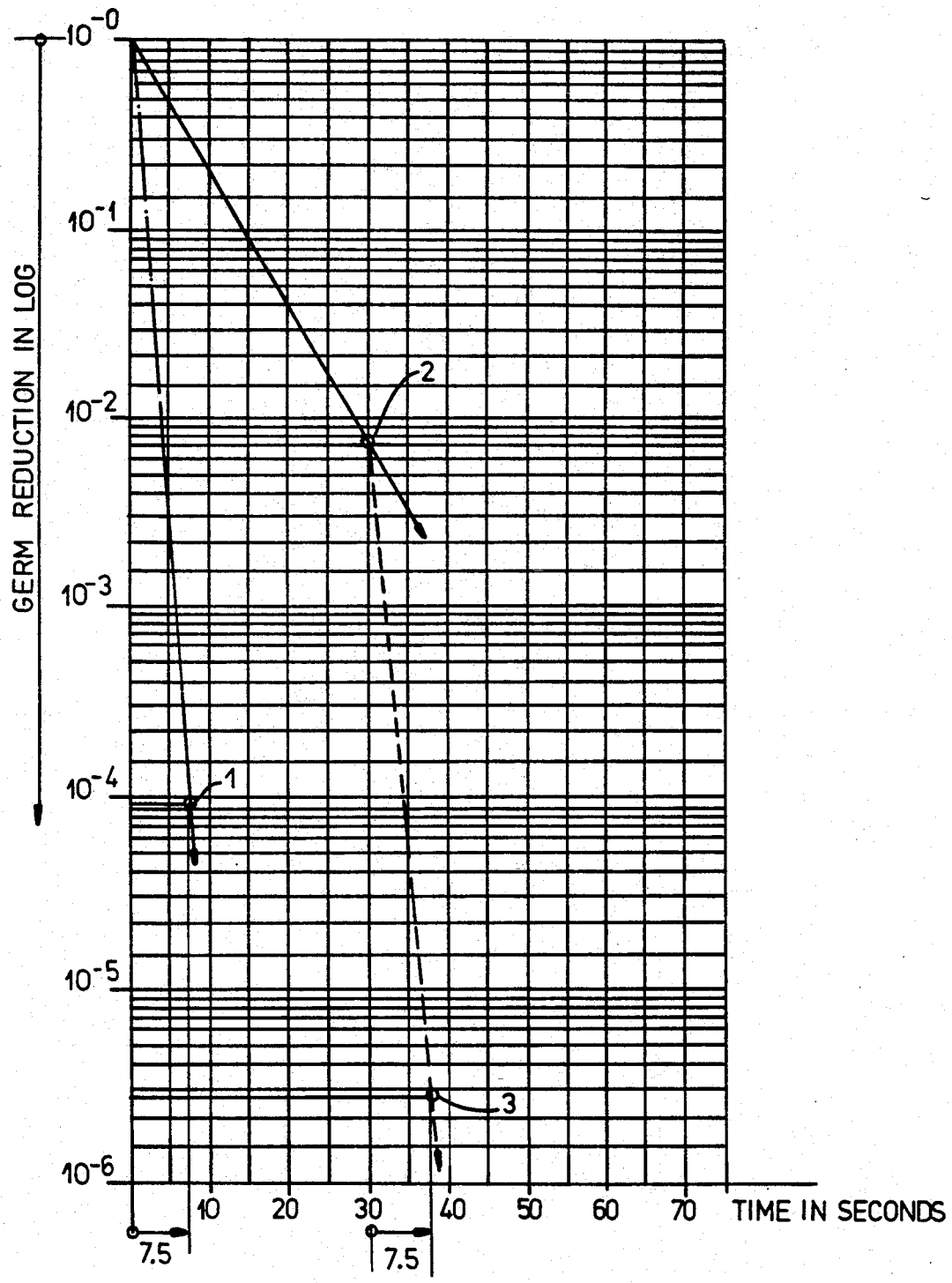
FIG. 4 is a semilogarithmic graph illustrating the invention.

In the graph of FIG. 4 the results of two tests have been shown, comparatively for a typical sterilizing process, in which the cups were contaminated with bacillus subtilis spores, one test being effected without presterilization and another with presterilization.

The time for sterilization is plotted along the abscissa in seconds whereas the germ ordinate in log is plotted along the ordinate. The objects to be sterilized were conventional plastic cups for the packaging of comestibles.

The sterilizing agent used was 35% aqueous $H_2O_2$solutions. The points (1) (2) and (3) on the graphs have the following significance:

(1)=without sterilization (germ reduction=4.02 log)
(2)=presterilization (germ reduction=2.3 log)
(2)+(3)=presterilization with subsequent sterilization (germ reduction=5.75 log).

Of course, the invention is not limited to the illustrated system. It is conceivable that the presterilizing chamber can be provided laterally of the sterilizing chamber and that the transport means, instead of worms, can be some other transporter for shifting the cups between the chambers, like chains with grippers or the like.

I claim:

1. A method of sterile packaging using stacked packaging elements, comprising the steps of:

(a) presterilizing in a presterilizing area within a housing said packaging elements with at least partial separation thereof from a stack of said elements prior to entry thereof into a separate sterilizing chamber of a filling and sealing machine, said presterilizing area being formed with a presterilizing chamber , a fluid-distribution space and a partition with a plurality of throughgoing openings separating said space from an $H_2O_2$ vapor outlet, said presterilizing chamber functioning to receive said packaging elements and being positioned between said $H_2O_2$ vapor outlet and said partition, said presterilizing step including:

(a1) passing said packaging elements through said presterilizing chamber between said partition and said $H_2O_2$ vapor outlet;

(a2) passing $H_2O_2$ vapor through said plurality of throughgoing openings to facilitate uniform distribution of said vapor onto said elements to thereby presterilize said elements; and (a3) discharging said vapor via said vapor outlet and said presterilized packaging elements from said presterilizing chamber;

(b) introducing said presterilized packaging elements from step (a) into said separate sterilizing chamber of said filling and sealing machine through an opening connecting sad presterilizing and sterilizing chambers and contacting said elements in said sterilizing chamber with $H_2O_2$ vapor, thereby condensing $H_2O_2$ on said elements, and thereafter contacting said elements with hot sterile air to remove $H_2O_2$ from said elements to complete sterilization thereof;

(c) directing said $H_2O_2$-containing air and hot sterile air from said sterilizing to said presterilizing chamber via a duct external to both said chambers and then through said openings in said partition to contact a new charge of packaging elements; and (d) effecting sterile packaging in said machine with said elements that exit said sterilizing chamber.

2. The method defined in claim 1 wherein said elements are plastic cups adapted to receive a food product.

3. The method defined in claim 1 wherein said $H_2O_2$-containing air has an $H_2O_2$ concentration of 2000 to 2500 ppm.

4. The method defined in claim 1 wherein said $H_2O_2$-containing air has a temperature of at least 90° C.

5. The method defined in claim 1 wherein the presterilization in step (a) is carried out for a period of at least 30 seconds.

6. An apparatus for sterile packaging using stacked packaging elements, comprising:

a presterilizing area within a housing to presterilize said packaging elements having an upper inlet opening and a lower outlet opening for respective entry and exit from said area of said packaging elements with at least partial separation thereof from a stack of said elements, said presterilizing area including a presterilziing chamber, a fluid-distribution space and a partition with a plurality of throughgoing openings separating said space from an $H_2O_2$ vapor outlet, said partition functioning to facilitate uniform distribution of $H_2O_2$ vapor to the elements, said presterilizing chamber functioning to receive said packaging elements and being positioned between said $H_2O_2$ vapor outlet and said partition;

a filling and sealing machine having a separate sterilizing chamber formed with an upper inlet opening receiving said elements from said lower outlet opening of said presterilizing area, said sterilizing chamber having a lower outlet opening for discharging said elements;

means for contacting said elements in said sterilizing chamber with $H_2O_2$ vapor, thereby condensing $H_2O_2$ on said elements, and thereafter contact said elements in said sterilizing chamber with hot sterile air to remove $H_2O_2$ from said elements and complete sterilization thereof, sterile packaging with said elements in said machine being thereafter effected; and a duct external to both said chambers for delivering said $H_2O_2$-containing air and hot sterile air from said sterilizing to said presterilizing chamber at a point on a side of said partition distant from said $H_2O_2$ vapor outlet so that said $H_2O_2$-containing air and hot sterile air pass through said partition openings to reach said elements.

7. The apparatus defined in claim 6, further comprising a suction duct connected to said presterilizing chamber.

8. The apparatus defined in claim 6 wherein said presterilizing chamber is located directly above said sterilizing chamber.

9. The apparatus defined in claim 7 wherein said ducts communicate with said presterilizing chamber at substantially opposite sides thereof.

10. The apparatus defined in claim 6 wherein said elements are plastic cups adapted to receive a food product, said throughgoing openings being directed downwardly into said cups.

11. The apparatus defined in claim 6 wherein said chambers are provided with baffles opposite respective inlets to said chambers.

12. The apparatus defined in claim 8 wherein said chambers have respective inlet sides which lie diametrically opposite one another.

13. The apparatus defined in claim 8, further comprising transport means for displacing said elements through the respective chambers.

14. The apparatus defined in claim 13 wherein said transport means maintains a smaller spacing of said elements in said presterilizing chamber than in said sterilizing chamber.

15. The apparatus defined in claim 13 wherein said transport means includes a one piece conveyor worm traversing through both of said chambers.

16. The apparatus defined in claim 13 wherein said sterilization chamber constitutes one of a plurality of sterilizing chambers connected in parallel and said presterilizing chamber constitutes one of a plurality of presterilizing chambers connected in parallel.

* * * * *